US006971513B2

(12) United States Patent
Weinstein et al.

(10) Patent No.: US 6,971,513 B2
(45) Date of Patent: Dec. 6, 2005

(54) PACKAGING SYSTEM FOR DOOR HARDWARE

(75) Inventors: Michael Weinstein, Costa Mesa, CA (US); Eric E. Thompson, Costa Mesa, CA (US)

(73) Assignee: Newfrey LLC, Newark, DE (US)

( * ) Notice: Subject to any disclaimer, the term of this patent is extended or adjusted under 35 U.S.C. 154(b) by 67 days.

(21) Appl. No.: 09/789,302

(22) Filed: Feb. 20, 2001

(65) Prior Publication Data

US 2001/0032795 A1 Oct. 25, 2001

Related U.S. Application Data

(60) Provisional application No. 60/183,853, filed on Feb. 22, 2000.

(51) Int. Cl.[7] ..... B65D 85/00

(52) U.S. Cl. ..... 206/321; 206/446; 206/485; 206/776

(58) Field of Search ..... 206/321, 477, 206/481, 764, 765, 485, 479, 482, 483, 487

(56) References Cited

U.S. PATENT DOCUMENTS

| | | | | | |
|---|---|---|---|---|---|
| 1,744,956 | A | * | 1/1930 | Fischer | 206/443 |
| 2,120,826 | A | * | 6/1938 | Young | 206/6.1 |
| 2,262,472 | A | * | 11/1941 | Sloan | 206/755 |
| 2,636,600 | A | * | 4/1953 | Denton et al. | 206/306 |
| 3,406,816 | A | | 10/1968 | Green et al. | |
| 3,638,783 | A | * | 2/1972 | Enseki et al. | 206/481 |
| 3,837,479 | A | * | 9/1974 | Lehmann | 206/489 |
| 3,880,283 | A | * | 4/1975 | Flaherty et al. | 206/316.1 |
| D244,259 | S | | 5/1977 | Bergstein | |
| 4,099,612 | A | | 7/1978 | Hanson | |
| 4,307,803 | A | | 12/1981 | Johnson | |
| 4,349,102 | A | | 9/1982 | Strongwater | |
| 4,359,182 | A | | 11/1982 | Perkins, Jr. | |
| 4,420,076 | A | | 12/1983 | Beveridge et al. | |
| D275,788 | S | * | 10/1984 | Givner et al. | D24/223 |
| D289,143 | S | | 4/1987 | Guillaume | |
| D299,114 | S | | 12/1988 | Klinge | |
| 4,940,135 | A | | 7/1990 | Hall | |
| 4,993,623 | A | | 2/1991 | Kelly et al. | |
| D315,095 | S | | 3/1991 | Wright | |
| D315,302 | S | | 3/1991 | Kistler | |
| D320,469 | S | | 10/1991 | Hoenig | |
| 5,064,056 | A | | 11/1991 | Gresh | |
| D328,248 | S | | 7/1992 | Ruff | |
| D350,460 | S | | 9/1994 | Picozza et al. | |
| 5,350,058 | A | | 9/1994 | Keough | |
| D362,801 | S | | 10/1995 | Milroy | |
| D367,226 | S | | 2/1996 | Ransbottom | |
| 5,509,528 | A | | 4/1996 | Weisburn | |
| 5,718,335 | A | | 2/1998 | Boudreaux | |
| D394,384 | S | | 5/1998 | Humphrey | |

(Continued)

*Primary Examiner*—Mickey Yu
*Assistant Examiner*—Jerrold Johnson
(74) *Attorney, Agent, or Firm*—Harness, Dickey & Pierce, P.L.C.

(57) ABSTRACT

A packaging system for a door knob assembly is disclosed which includes a clear or translucent extruded tubular member for encasing a door knob, lever, deadbolt or other door hardware or accessory. A pair of end caps are disposed at opposite ends of the tubular member for defining a packaging volume therein. The particular door hardware contained within the packaging system may be supported on an insert which further provides a storage volume within the packaging system for additional components of the lockset. Retaining flanges extend from the end caps for releasably securing the packaged door hardware within the packaging system.

30 Claims, 8 Drawing Sheets

U.S. PATENT DOCUMENTS

| | | | |
|---|---|---|---|
| 5,816,411 | A | 10/1998 | Smith |
| D400,787 | S | 11/1998 | Keener |
| D405,370 | S | 2/1999 | Humphrey |
| D406,056 | S | 2/1999 | Flores et al. |
| D406,528 | S | 3/1999 | Flores et al. |
| 5,890,593 | A | 4/1999 | Humphrey |
| D414,108 | S | 9/1999 | Humphrey |
| D424,427 | S | 5/2000 | Saputo et al. |
| D434,980 | S | 12/2000 | Suzuki |

* cited by examiner

PACKAGING SYSTEM FOR DOOR HARDWARE

This application claims priority under 35 U.S.C. §119(e) to U.S. Provisional Application No. 60/183,853 filed on Feb. 22, 2000, and entitled "Packaging System For Door Hardware" the specification and drawings of which are hereby expressly incorporated by reference.

BACKGROUND AND SUMMARY OF THE INVENTION

The present invention relates generally to a packaging assembly for door hardware, and more particularly to a tubular packaging assembly effective for storing and displaying various door hardware components.

The present invention is directed to a packaging assembly having a platformed, free-standing package which securely holds the components of the door knob assembly while at the same time minimizing the footprint of the packaging and providing maximum visibility of the product to the consumer. The present invention includes a tubular member having a pair of end caps disposed on opposite ends of the tubular member and an insert secured to one of the end caps to locate and releasably secure the door knob hardware within the tubular member. The end caps are identical components having a retaining flange extending from an interior surface thereof which cooperates with the inside surface of the tubular member to provide a friction fit therebetween. In addition, a second flange extends inwardly from the inner surface of the cap and provides a retaining element for positioning and securely retaining the door hardware within the tubular member. An insert is incorporated into the interior of the packaging for locating the door hardware in an elevated position within the tubular member. Furthermore, additional door hardware components may be packaged within a storage volume between the insert and the end cap.

As presently preferred, the door hardware may be vertically or horizontally oriented within the tubular member depending on the type of hardware. The use of a tubular member as opposed to bubble packaging conventionally used significantly increases the number of items which may be placed on retail shelving. Furthermore, the compact nature of the packaging system significantly reduces shipping and handling costs. As presently preferred, the tubular member is fabricated from a clear or translucent extruded plastic which affords consumers a full view of the door hardware from all sides. As a result, a significant decrease in package opening at the retail store can be expected since consumers are able to inventory all of the components of the product as well as obtain a thorough visual inspection thereof. Furthermore, the generally tubular shape facilitates manual, as well automated handling during the distribution process.

DETAILED DESCRIPTION OF THE INVENTION

Figure 1:
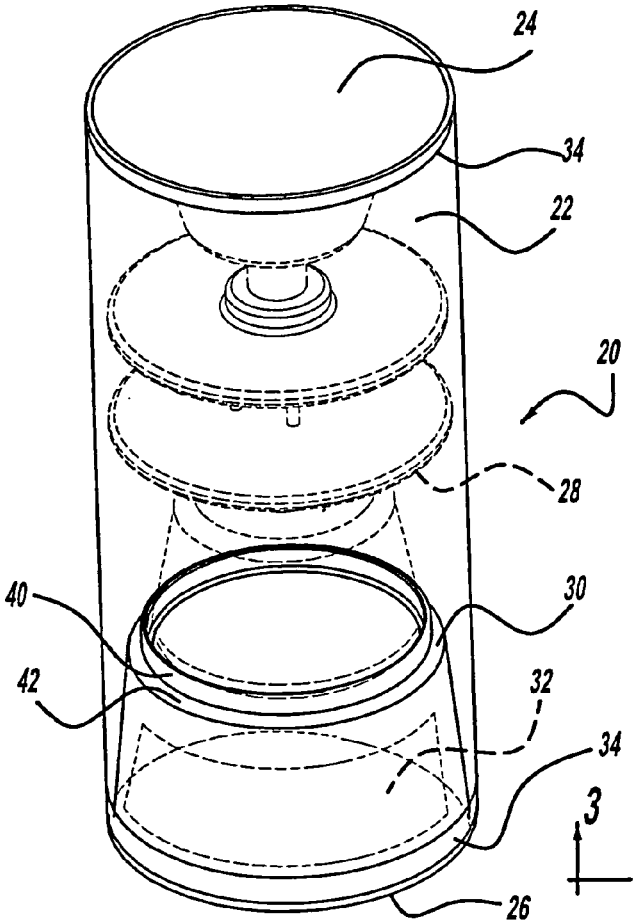
FIG. 1 is a perspective view of a first preferred embodiment of the present invention in which a knob-type lock is packaged within a cylindrical tubular member.
Figure 2:
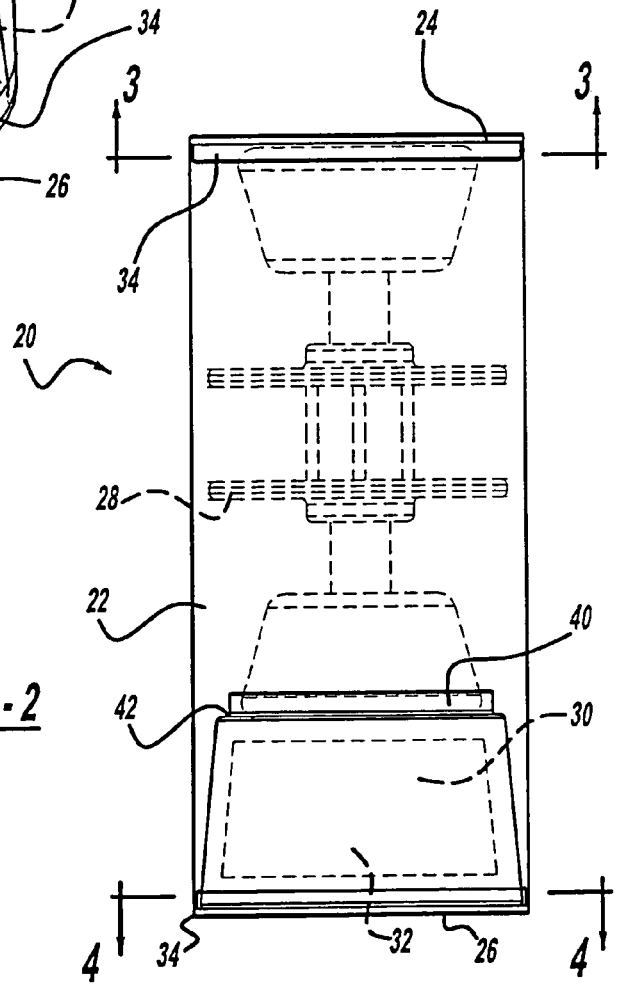
FIG. 2 is an elevational view of the packaging system illustrated in FIG. 1.
Figure 3:
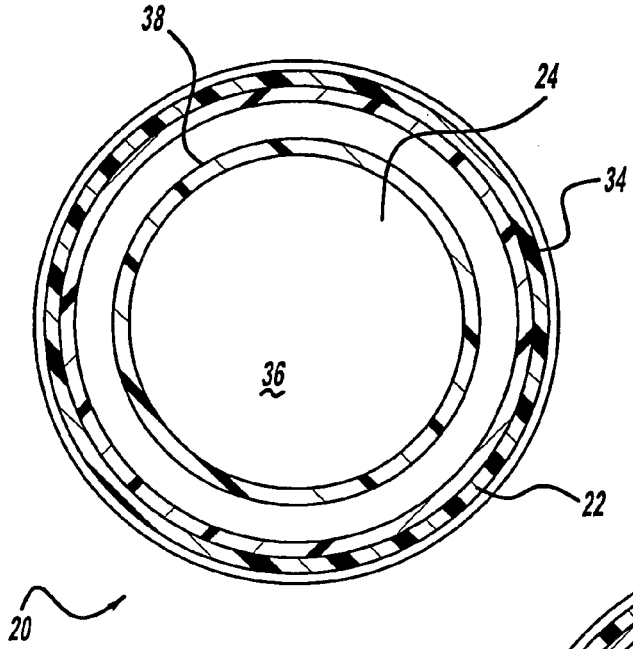
FIG. 3 is a cross-sectional view taken along line 3—3 shown in FIG. 2.
Figure 4:
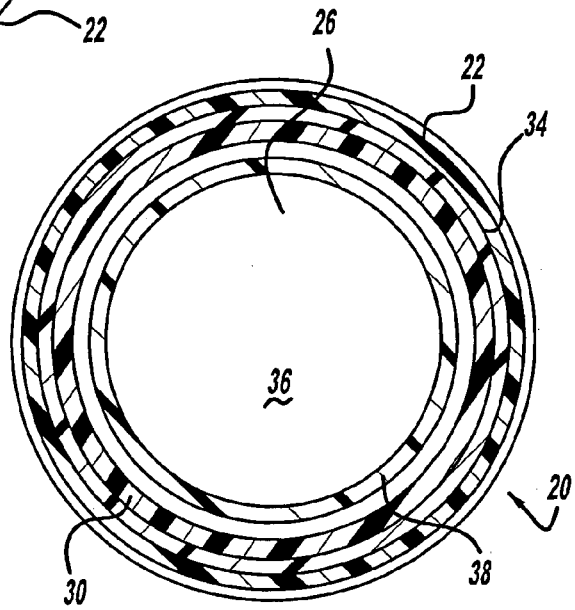
FIG. 4 is a cross-sectional view taken along line 4—4 shown in FIG. 2.
Figure 5:
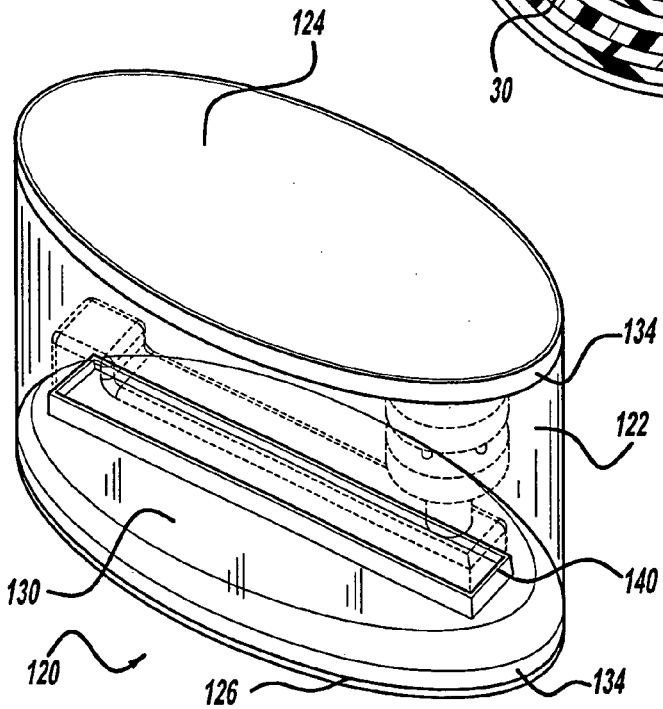
FIG. 5 is a perspective view of a second preferred embodiment of the present invention in which a lever-type lockset is packaged within an elliptical tubular member.
Figure 6:
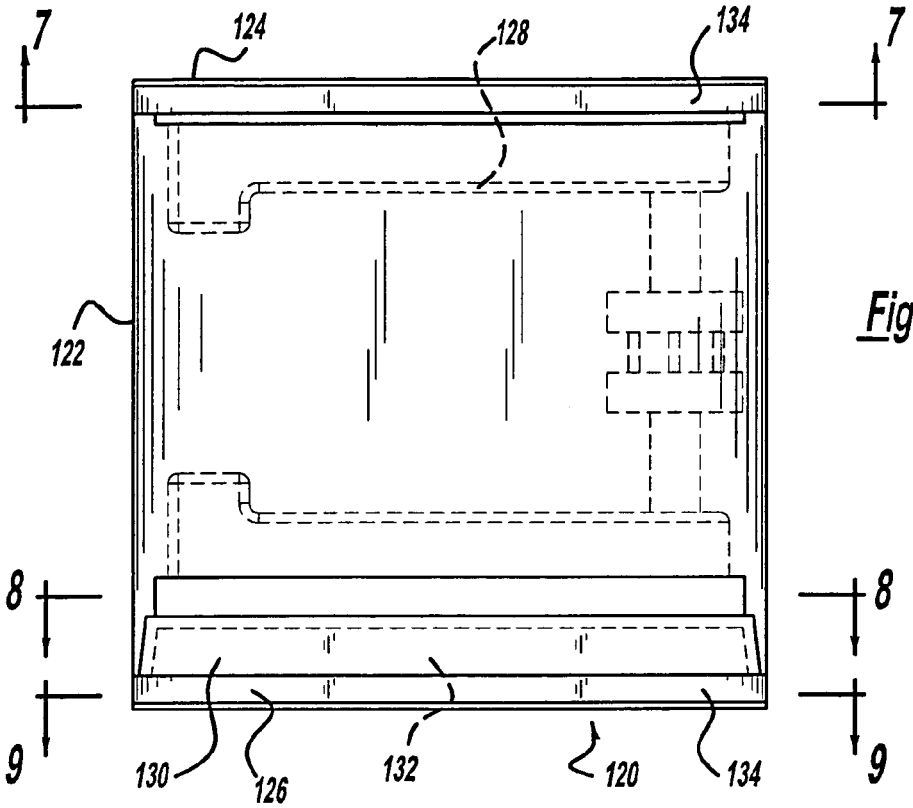
FIG. 6 is a cross-sectional view of the packaging system illustrated in FIG. 5.

With respect to FIGS. 1–4, a first preferred embodiment of the present invention is illustrated. Packaging system 20 includes a plastic tubular member 22 having a pair of end caps 24, 26 disposed on opposite ends thereof and defining an interior volume for enclosing a door knob assembly 28. Insert 30 is interdisposed between end cap 26 and door knob assembly 28. In this regard, insert 30 functions to elevate door knob assembly 28 within packaging system 20 to enhance display thereof. As best illustrated in FIG. 2, insert 30 also functions to provide a storage volume 32 beneath door knob assembly 28 within which the additional components of the lockset mechanism (such as the latchbolt, latch plate or fasteners) may be stored. While packaging system 20 is illustrated as packaging a door knob assembly, one skilled in the art will recognize that different door hardware such as a deadbolt assembly could be packaged within packaging system 20 in a generally vertical orientation.

End caps 24, 26 have an outer flange 34 extending from an inner surface 36 thereof. Outer flange 34 is complimentary to the inner surface of tubular member 22 and functions to position and frictionally retain end caps 24, 26 on tubular member 22. For example, in the illustrated embodiment, tubular member 22, and hence outer flange 34 have a complementary circular configuration. However, one skilled in the art will readily recognize that tubular member 22 and outer flange 34 may take on a variety of cross-sectional shapes including, but not limited to square, rectangular, circular, triangular, polygonal, elliptical or any other multi-sided shape. End caps 24, 26 further include an inner retaining flange 38 extending from inner surface 36. Inner retaining flange 38 of upper end cap 24 functions to releasably secure a knob portion of door knob assembly 28 within packaging system 20. Inner retaining flange 38 of lower end cap 26 functions to releasably secure the bottom edge of insert 30 within packaging system 20. Insert retaining flange 40 extends from upper surface 42 formed on insert 30. Insert retaining flange 40 engages and releasably secures a knob portion of door knob assembly 28 within packaging system 20.

Figure 21:
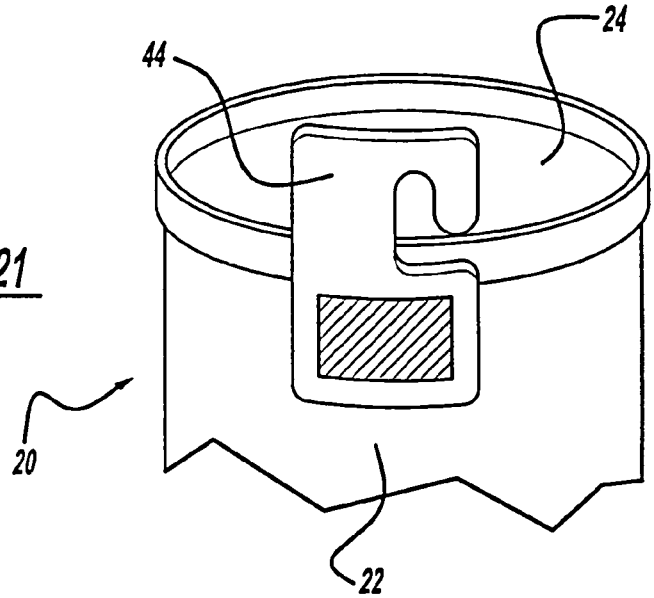
FIG. 21 illustrates an upper portion of a packaging system in accordance with the present invention having a hanger tab secured thereto.
Figure 22:
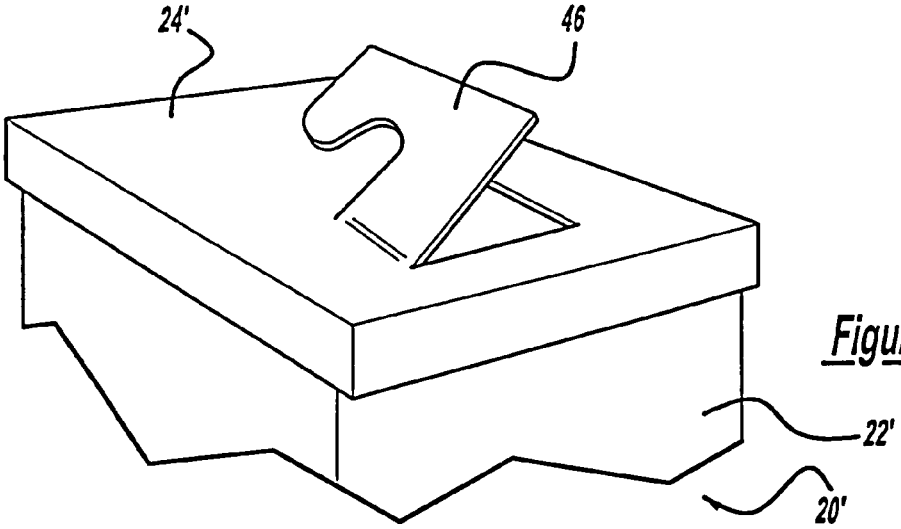
FIG. 22 is an alternate embodiment illustrating a hanger tab integrally formed in the cap portion of the packaging assembly.

Outer retaining flange 34 is dimensioned to provide a slight interference fit with the interior diameter of tubular member 24 such that a sufficient friction fit may be provided for releasably securing the end caps to the tubular member. However, a suitable adhesive may be utilized at the interface therebetween. Alternatively, an external tape or shrink wrap may also be utilized to reinforce the interface between end caps 24, 26 and tubular member 22, as well as to provide a tamper-indicating feature. As presently preferred, packaging system 20 is designed to stand vertically upon retail shelving for displaying the merchandise contained therein. However, packaging system 20 may further be provided with hanger details to display the packaged product on a vertical hanging-type board. For example, as illustrated in FIG. 21, a supplemental hanger hook 44 may be secured to the outer surface of tubular member 22 and provide means for hanging packaging system 20. A presently preferred hanger hook is distributed by Do-It Manufacturing. Alternately, as illustrated in FIG. 22, a hanger hook 46 may be integrally formed within upper end cap 24 such that packaging system 20 may either be displayed vertically upon the retail shelf or alternately hung from a vertical display board.

With specific reference now to FIGS. 5–9, a second preferred embodiment of the present invention is illustrated in which packaging system 120 is particularly adapted for a lever-type lockset mechanism. Packaging system 120 includes a tubular member 122 having a pair of end caps 124, 126 disposed on opposite ends thereof. Lever-type lockset 128 is supported on insert 130 above lower end cap 126. Insert 130 further provides a storage volume 132 below door knob assembly 128 for packaging additional components of the lockset.

Figure 7:
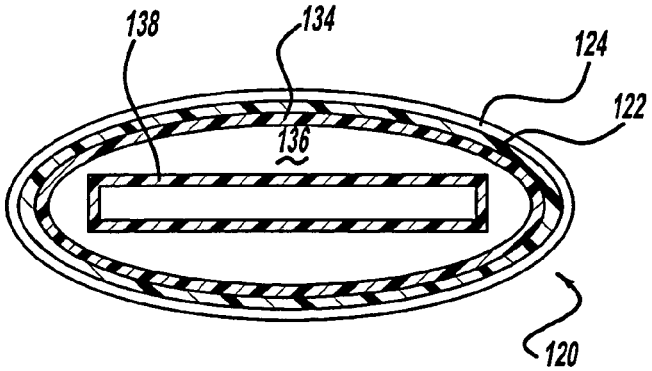
FIG. 7 is a cross-sectional view taken along line 7—7 shown in FIG. 6.
Figure 8:
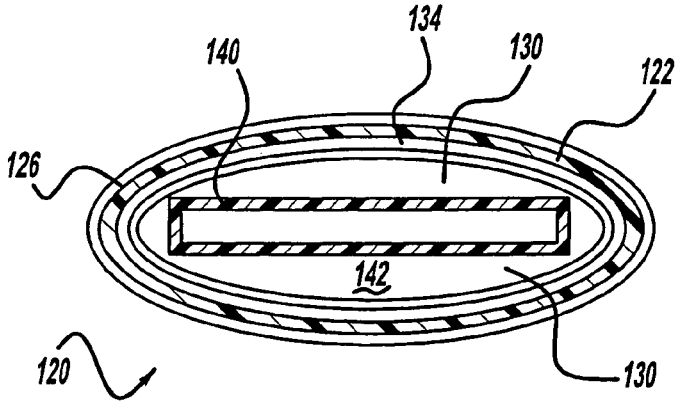
FIG. 8 is a cross-sectional view taken along line 8—8 shown in FIG. 6.
Figure 9:
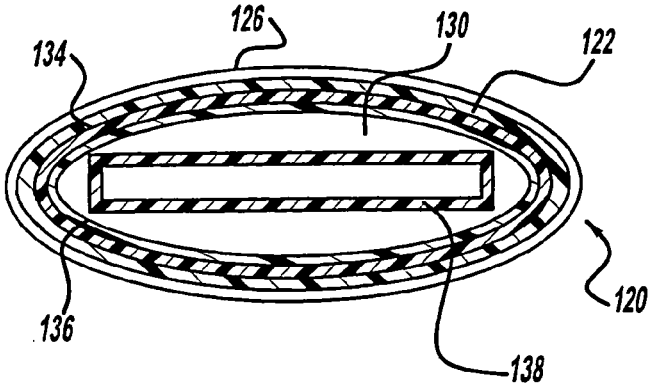
FIG. 9 is a cross-sectional view taken along line 9—9 shown in FIG. 6.
Figure 10:
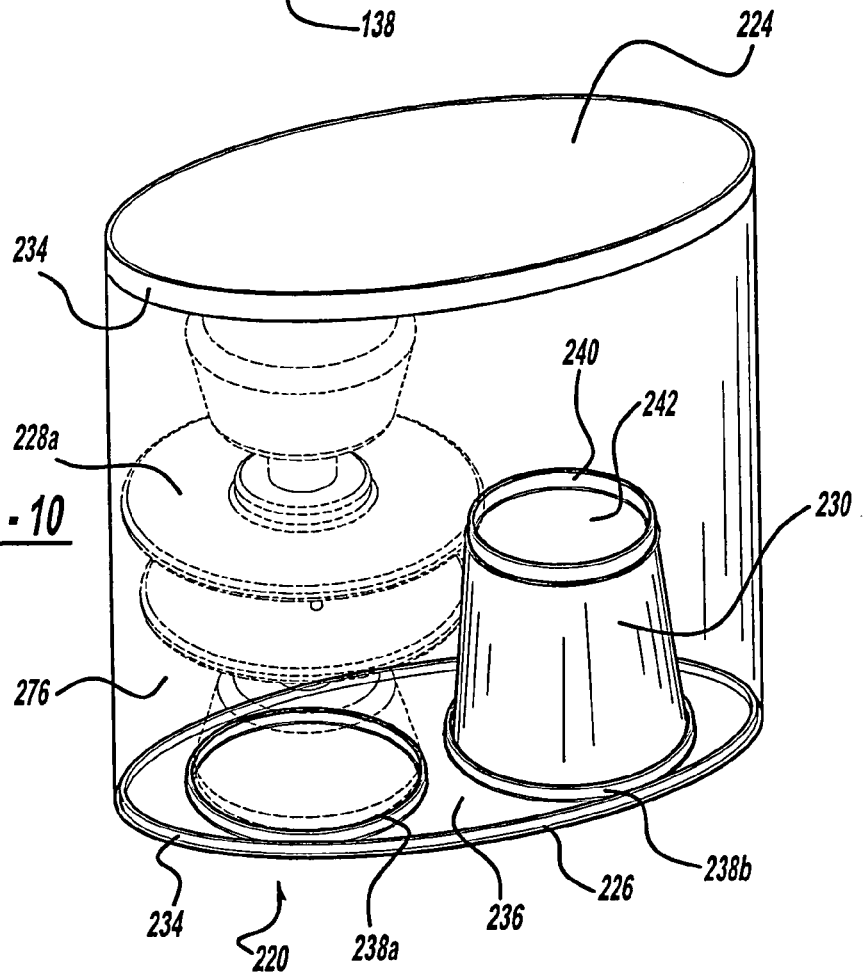
FIG. 10 is a perspective view of a third preferred embodiment of the present invention in which a knob type lockset and complementary deadbolt are packaged within an elliptical tubular member.

With particular reference to FIGS. 7 and 9, outer retaining flange 134 extends from inner surface 136 of end caps 124, 126. Outer retaining flange 134 is configured to be complementary to the interior surface of tubular member 122. Outer retaining flange 134 of lower end cap 126 is also configured to engage the lower edge of insert 130 to releasably insert it thereto. Inner retaining flange 138 extends from inner surface 136 of end caps 124, 126. Inner retaining flange 138 of upper end cap 124 is configured to releasably secure the lever portion of lever-type lockset assembly 128. An insert retaining flange 140 is formed on an upper surface 142 of insert 130 and is configured to engage the lever portion of lever-type lockset assembly 128 opposite upper end cap 124. As illustrated, inner retaining flange 138 and insert retaining flange 140 are generally rectangular; however one skilled in the art will recognize that these flange may be configured to a particular lever style to be packaged within the present invention.

As presently preferred, packaging system 120 has an elliptical cross-section which efficiently packages lever-type locksets. However, one skilled in the art will readily recognize that other geometric configurations may be utilized in accordance with the present invention. Packaging system 120 is particularly configured for vertical display on retail shelving. However, packaging system 120 may also be adapted with suitable hanger hooks, as discussed above in reference to the first preferred embodiment. In view of the elliptical cross-section of packaging system 120, it is presently preferred to utilize at least two hanger hooks disposed approximately equal distance from a center line of the tubular member. In this manner, packaging system 120 may be properly displayed on a pair of laterally extending display hooks without regard to the center of gravity associated with the components contained therein.

Similar to the first preferred embodiment, outer retaining flanges 134 provide an interference fit with tubular member 122 for releasably securing end caps 124, 126 thereto. A suitable adhesive and/or additional tape or shrink wrap may be utilized to further secure end caps 124, 126 to tubular member 122.

Figure 12:
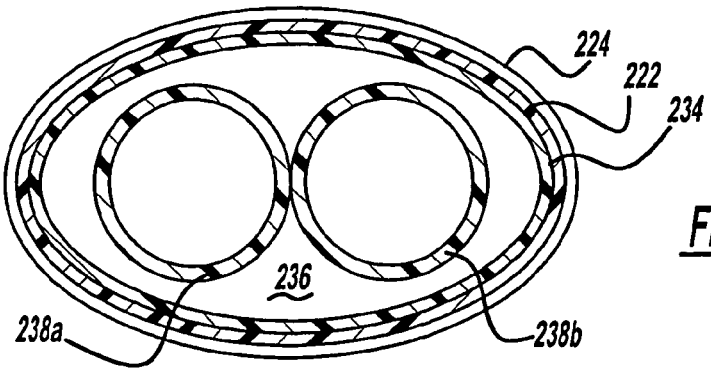
FIG. 12 is a cross-sectional view taken along the line 12—12 shown in FIG. 11.
Figure 11:
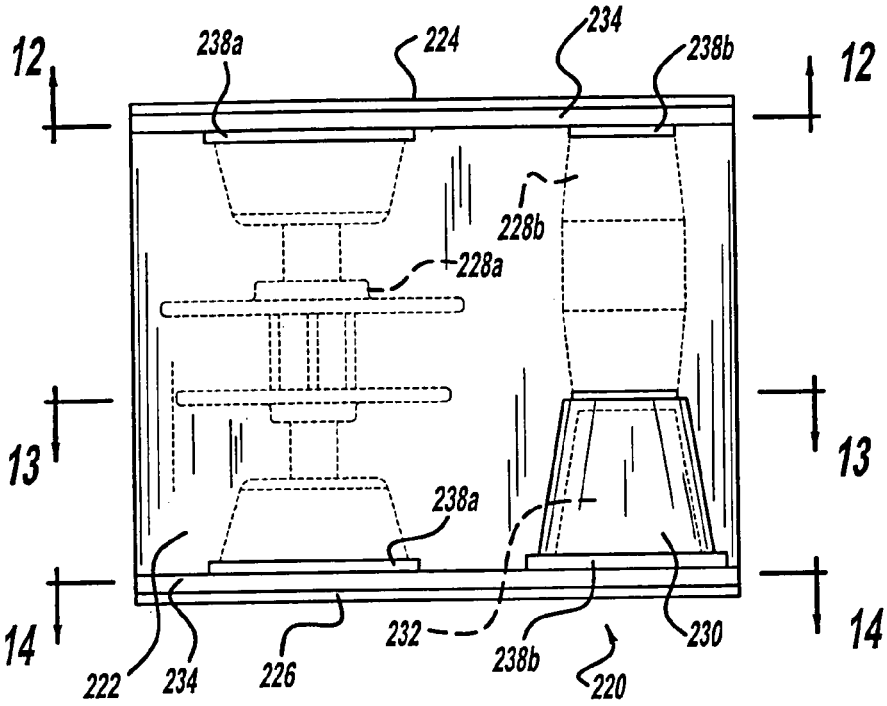
FIG. 11 is a cross-sectional view of the packaging system illustrated in FIG. 10.
Figure 13:
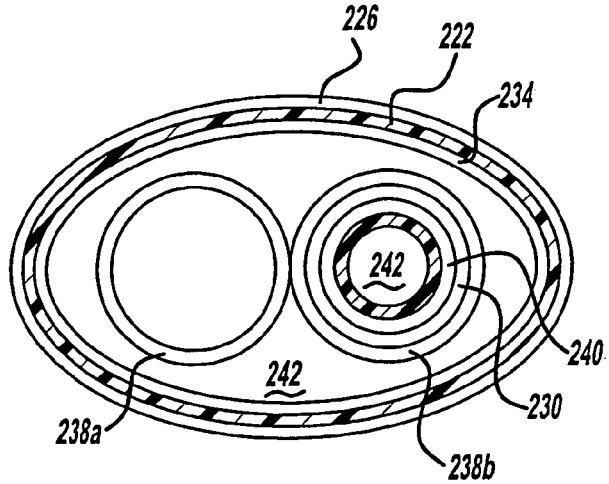
FIG. 13 is a cross-sectional view taken along the line 13—13 shown in FIG. 11.
Figure 14:
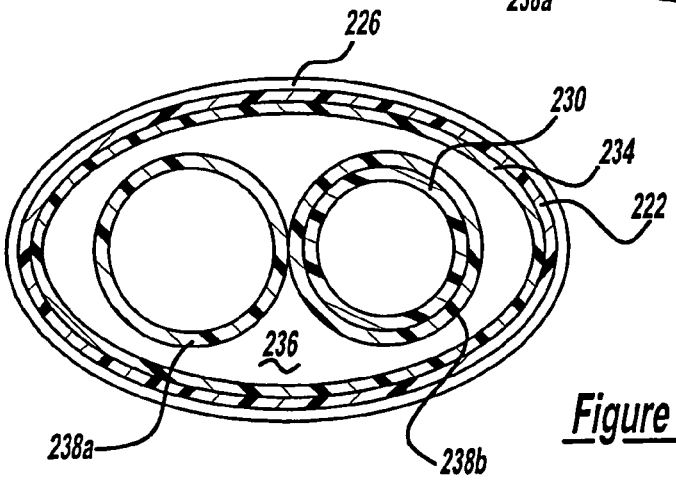
FIG. 14 is a cross-sectional view taken along the line 14—14 shown in FIG. 11.
Figure 15:
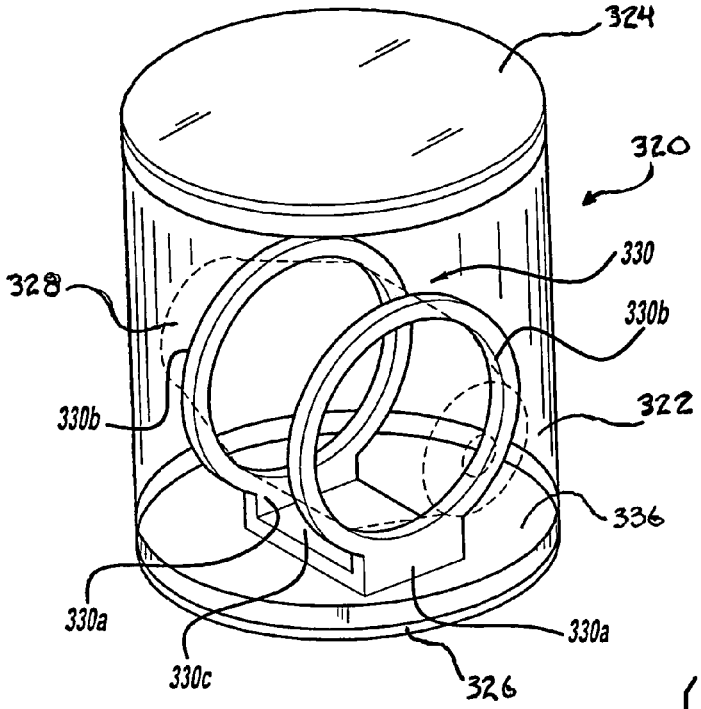
FIG. 15 is a perspective view of a fourth preferred embodiment of the present invention in which a deadbolt mechanism is packaged within a tubular member having a circular cross-section.
Figure 16:
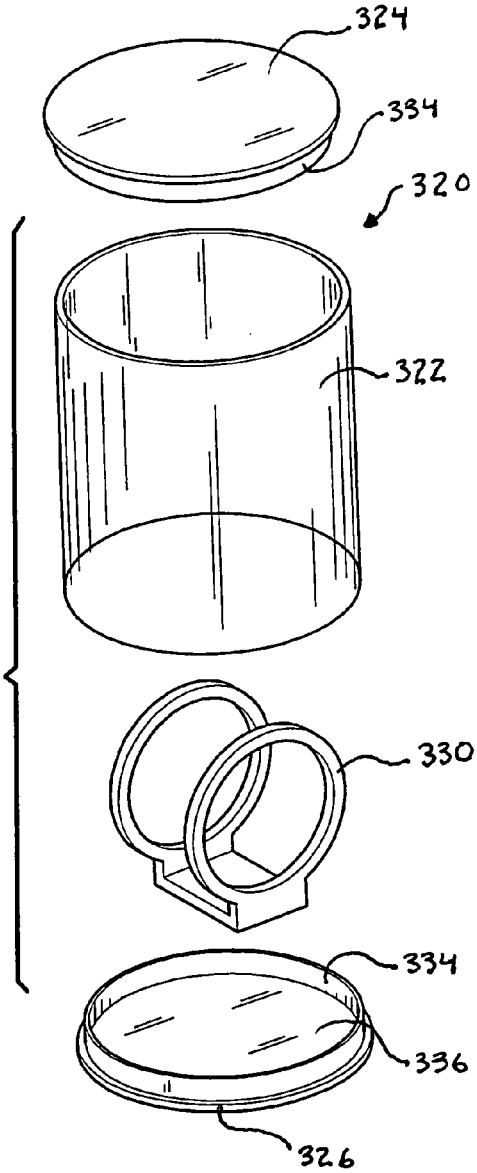
FIG. 16 is an exploded perspective view of the packaging system illustrated in FIG. 15.
Figure 17:
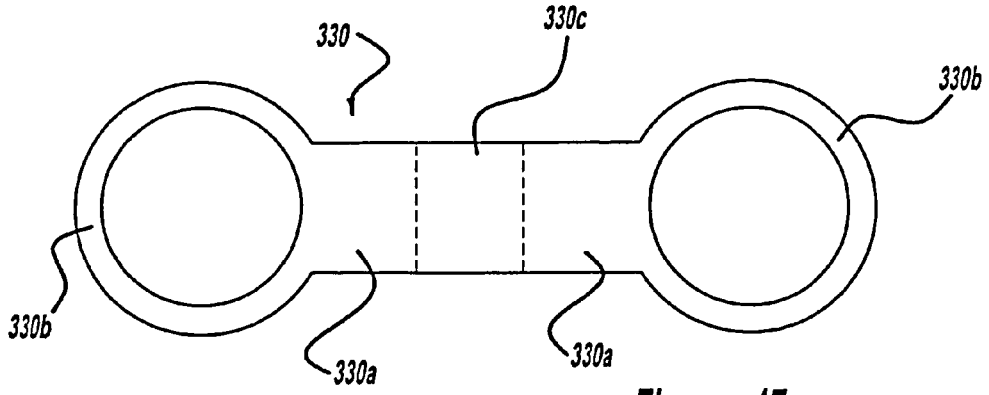
FIG. 17 is an insert detail of the packaging system illustrated in FIG. 15.
Figure 18:
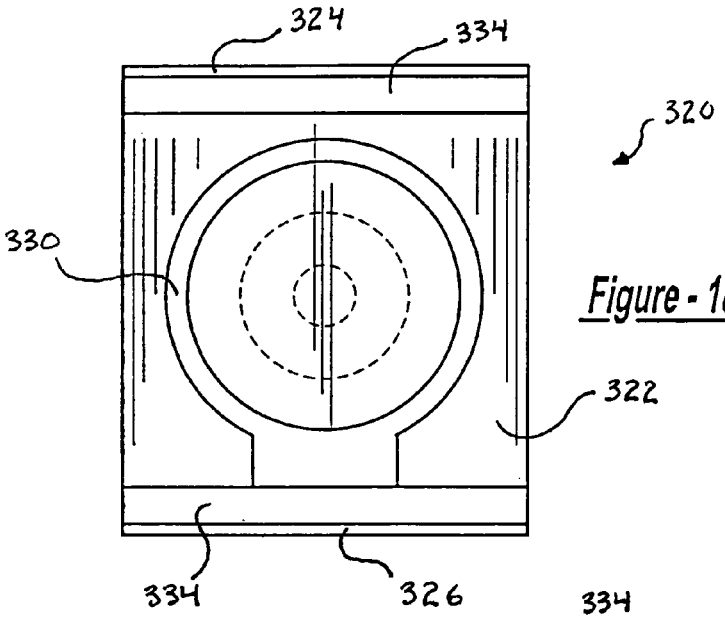
FIG. 18 is a front view of the packaging system illustrated in FIG. 15.
Figure 19:
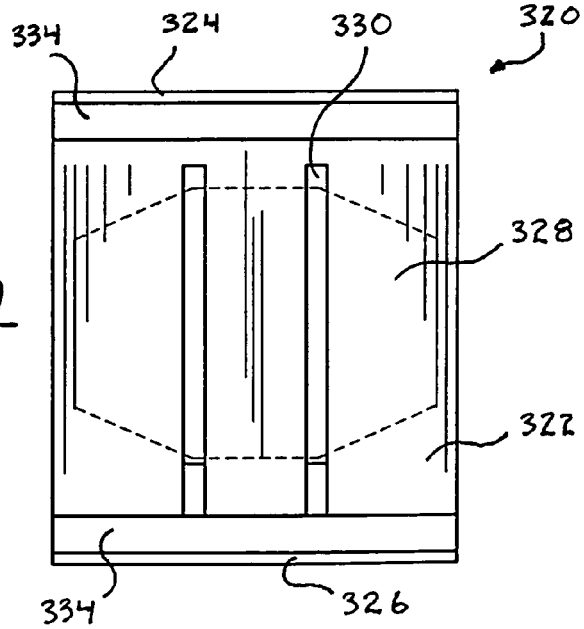
FIG. 19 is a side view of the packaging system illustrated in FIG. 15.
Figure 20:
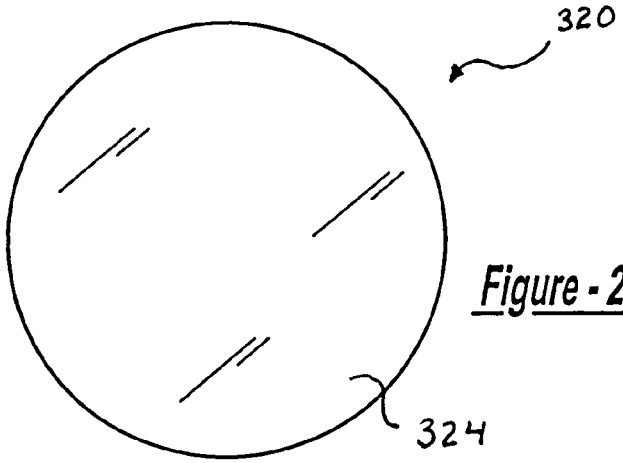
FIG. 20 is a top view of the packaging system illustrated in FIG. 15.

With reference now to FIGS. 10–14, a third preferred embodiment of the present invention is illustrated which is particularly adapted for packaging a knob-type lockset and its companion deadbolt mechanism. Packaging system 220 includes tubular member 222 and a pair of end caps 224, 226 disposed on opposite ends thereof to define an interior packaging volume. Door knob lockset **228*a* is releasably secured within the packaging volume by end caps 224, 226. Deadbolt mechanism 228*b* is disposed within tubular member 222 in an elevated position on top of insert 230. In this regard, deadbolt mechanism 228 is interdisposed between upper end cap 224 and insert 230. Insert 230 is supported on lower end cap 226 and defines a storage volume where various components of the lockset may be packaged. With particular reference to FIGS. 12 and 14, end caps 224, 226 have an outer retaining flange 234 extending from an interior surface 236 thereof. Outer retaining flange 234 has a complementary configuration to the inner surface of tubular member 222 such that it provides an interference or friction fit therebetween for releasably securing end caps 224, 226 to tubular member 222**.

End caps 224, 226 have a pair of inner retaining flanges **238*a*, 238*b* formed on interior surface 236. The first interior retaining flange 238*a* is configured to engage the outer circumference of a knob portion of door knob assembly 228*a* for releasably securing it within the packaging volume. The second retaining flange 238*b* formed on upper end cap 224 is configured to engage the outer circumference of deadbolt mechanism 228*b*. The second inner retaining flange 238*b* formed on lower end cap 226 is configured to engage and releasably secure insert 230 with lower end cap 226. An insert retaining flange 240 extends from an upper surface 242 of insert 230 and is adapted to engage and releasably secure the outer circumference of deadbolt mechanism 228 opposite upper end cap 224. As presently preferred, tubular member 222 has an elliptical cross-section which efficiently packages door knob assembly 228*a* and deadbolt mechanism 228*b* as a combination lockset assembly. Furthermore, packaging system 220 is particularly configured for display on retail shelving. However, packaging system 220 may be adapted with hanger hooks, similar to those previously discussed in conjunction with the second preferred embodiment, packaging system 120**.

With reference now to FIGS. 15–20, a fourth preferred embodiment of the present invention is illustrated which is particularly adapted for packaging a deadbolt mechanism. Packaging system 320 includes tubular member 322 and a pair of end caps 324, 326 disposed on opposite sides thereof to define an interior packaging volume. Deadbolt mechanism 328 is packaged within tubular member 322 in a generally horizontal orientation. More specifically, insert 330 is a generally U-shaped member having a pair of upwardly extending flanges 330*a* having a generally circular retaining portion 330*b* which is adapted to receive and retain the deadbolt mechanism 328. A base portion 330*c* interconnects upwardly extending flanges 330*a*. Insert 330 may be secured to the inner surface 336 of end cap 326 by a suitable adhesive or other mechanical feature such as a fastener or molded retaining flange.

End caps 324, 326 have a retaining flange 334 extending from the inner surface 336 thereof. Retaining flange 334 has a complementary configuration to the inner surface of the tubular member 322 such that it provides an interference or friction fit therebetween for releasably securing end caps 324, 326 to tubular member 322. A suitable adhesive may be utilized at the interface between end cap 324, 326 and tubular member 322. Likewise, an external tape or shrink wrap may also be utilized to reinforce the interface therebetween, as well as providing a tamper-indicating feature.

As presently preferred, tubular member 322 has a circular cross-section which efficiently packages deadbolt mechanism 328. However, one skilled in the art will readily recognize that other geometric configurations may be utilized in accordance with the present invention. For example, a tubular member having generally arcuate side walls and planar front and rear face may be utilized for packaging system 320. Furthermore, packaging system 320 is particularly configured for display on retail shelving. However, packaging system 320 may also be adapted with hanger hooks similar to those previously discussed.

As presently preferred, the retaining flanges formed on the end caps provide a substantially continuous circumference for engaging and releasably securing the door knob assembly with the end cap. However, one skilled in the art will readily recognize that a retaining flange having a discontinuous configuration or multiple retaining projections extending from the inner surface of the end caps could be substituted for the continuously extending retaining flange illustrated in the preferred embodiment and thus, such configurations are to be contemplated within the scope of the present invention.

As presently preferred, tubular members 22, 122, 222 and 322 are fabricated from a clear or translucent extruded tube of a plastic material such as PVC. As previously discussed, the shape, though not limited, can be rectangular, square, round, triangular, elliptical or any other multi-sided shape. End caps 24, 26, 124, 126, 224, 226, 324, 326 may be injection molded or vacuum formed and fabricated from metal, rubber, plastic or any other suitable material for this application. Furthermore, the cap may be formed either with or without some form of built-in hanging device. In accordance with the present invention, various graphics and/or marketing information may be printed directly onto the tubular member to facilitate the conveyance of information concerning the products contained therein.

While the present invention has been described with particular reference to various packaging systems, one skilled in the art will readily recognize that the present invention has applicability to other geometric configurations for packaging a wide range of door locksets and door-related hardware. Furthermore, those skilled in the art will readily recognize from the foregoing discussion and accompanying drawings and claims that changes, modifications and variations can be made therein without departing from the spirit and scope of the present invention as defined in the following claims.

What is claimed is:

1. A packaging system for door hardware comprising:

a tubular member having an inner surface, said tubular member defining a longitudinal axis;

a pair of end caps separate from said tubular member, each of said pair of end caps having a retaining element extending from an inner face thereof which is complementary to said inner surface removably securing said end cap to an end of said tubular member;

an insert having a base portion fixedly attached to one of said end caps and a pair of upwardly extending flange members, said pair of upwardly extending flange members having an aperture formed therethrough generally perpendicular to said longitudinal axis and adapted to receive a door hardware component in a generally horizontal orientation.

2. The packaging system of claim 1 wherein said pair of upwardly extending flange members have a generally circular aperture formed therein.

3. The packaging system of claim 1 wherein said pair of upwardly extending flange members are generally parallel to one another.

4. The packaging system of claim 1 further comprising a hanger hook extending above an outer face of one of said pair of end caps.

5. The packaging system of claim 4 wherein said hanger hook is integrally formed in one of said end caps.

6. The packaging system of claim 4 wherein said hanger hook is adhered to an outer surface of said tubular member.

7. The packaging system of claim 1 wherein said tubular member is fabricated from a translucent plastic material.

8. The packaging system of claim 1 wherein said tubular member is circular in cross section.

9. The packaging system of claim 1 further comprising an external tape surrounding the packaging system and overlapping an interface between one of said pair of end caps and said tubular member.

10. The packaging system of claim 1 further comprising a shrink wrap surrounding the packaging system and overlapping an interface between one of said pair of end caps and said tubular member.

11. The packaging system of claim 1 further comprising an adhesive between one of said pair of end caps and said tubular member for securing said end cap to said tubular member.

12. A packaging system for door hardware comprising:

a tubular member having an inner surface, said tubular member defining a longitudinal axis;

a pair of end caps separate from said tubular member, each of said pair of end caps having a retaining element extending from an inner surface thereof which is complementary to said inner surface releasably securing said end cap to an end of said tubular member, one of said pair of end caps having a pair of upwardly extending flange members fixedly attached thereto, said flange members having an aperture formed therethrough generally perpendicular to said longitudinal axis and adapted to receive a door hardware component in a generally horizontal orientation.

13. The packaging system of claim 12 wherein said pair of upwardly extending flange members have a generally circular aperture formed therein.

14. The packaging system of claim 12 wherein said pair of upwardly extending flange members are generally parallel to one another.

15. The packaging system of claim 12 further comprising a hanger hook extending above an outer face of one of said pair of end caps.

16. The packaging system of claim 15 wherein said hanger hook is integrally formed in one of said end caps.

17. The packaging system of claim 15 wherein said hanger hook is adhered to an outer surface of said tubular member.

18. The packaging system of claim 12 wherein said tubular member is fabricated from a translucent plastic material.

19. The packaging system of claim 12 wherein said tubular member is circular in cross section.

20. The packaging system of claim 12 further comprising an external tape surrounding the packaging system and overlapping an interface between one of said pair of end caps and said tubular member to provide a tamper indicator.

21. The packaging system of claim 12 further comprising a shrink wrap surrounding the packaging system and overlapping an interface between one of said pair of end caps and said tubular member to provide a tamper indicator.

22. The packaging system of claim 12 further comprising an adhesive between one of said pair of end caps and said tubular member for securing said end cap to said tubular member.

23. A packaging system for door hardware comprising:

a tubular member defining a longitudinal axis and further having an inner surface;

a pair of end caps separate from said tubular member, each of said pair of end caps having a retaining element extending from an inner face thereof which is complimentary to said inner surface;

an insert having a base portion secured to one of said pair of end caps and a pair of flange members extending from said one of said pair of end caps, said pair of flange members having an aperture generally perpendicular to said longitudinal axis of said tubular member adapted to receive a door hardware component and operable through cooperation with said tubular member to restrict movement of said door hardware component in a direction parallel to said longitudinal axis and a direction perpendicular to said longitudinal axis when said one of said pair of end caps is removably secured to said tubular member.

24. The packaging system for door hardware of claim 23, wherein said pair of flange members have a generally circular aperture formed threrein.

25. The packaging system for door hardware of claim 23, wherein said pair of flange members are generally parallel to each other.

26. The packaging system for door hardware of claim 23 further comprising a hanger hook extending above an outer face of one of said end caps.

27. The packaging system for door hardware of claim 23, wherein said tubular member is formed from a translucent plastic material.

28. The packaging system for door hardware of claim 23 further comprising an external tape surrounding the packaging system and overlapping an interface between one of said pair of end caps and said tubular member to provide a tamper indicator.

29. The packaging system of claim 23 further comprising a shrink wrap surrounding the packaging system and overlapping an interface between one of said pair of end caps and said tubular member to provide a tamper indicator.

30. The packaging system of claim 23 further comprising an adhesive between one of said pair of end caps and said tubular member for releasably securing said end cap to said tubular member.

* * * * *